United States Patent [19]

Blake et al.

[11] 4,213,856

[45] Jul. 22, 1980

[54] METHOD AND APPARATUS FOR CLASSIFYING SOLIDS AND TRANSPORTING SOLIDS-LADEN FLUID

[75] Inventors: Larry V. Blake, Bartlesville, Okla.; Donald E. Womeldorph, Jr., Sweeny, Tex.; Oliver M. Surber, Sweeny, Tex.; John P. James, Sweeny, Tex.

[73] Assignee: Phillips Petroleum Company, Bartlesville, Okla.

[21] Appl. No.: 965,718

[22] Filed: Dec. 1, 1978

[51] Int. Cl.[2] ..... B07B 1/00; B07B 7/06

[52] U.S. Cl. ..... 209/250; 209/11; 209/401; 165/119

[58] Field of Search ..... 209/10, 250, 281, 11, 209/17, 238, 401; 165/119, 174, 95, 105; 122/32; 208/353, 358; 260/683.48

[56] References Cited

U.S. PATENT DOCUMENTS

| | | | |
|---|---|---|---|
| 1,884,555 | 10/1932 | Brown | 122/32 |
| 2,919,118 | 12/1959 | Hunter | 165/119 |
| 3,133,014 | 5/1964 | Cross | 208/248 |
| 3,168,138 | 2/1965 | Stoker et al. | 165/119 |
| 3,338,821 | 8/1967 | Moyer et al. | 208/113 |

*Primary Examiner*—Ralph J. Hill

[57] ABSTRACT

A method and apparatus for classifying solids and transporting a solids-laden fluid containing large particle size solids which will tend to plug a tubular transport means and small particle size solids which will pass through the transport means without plugging, including passing the solids-laden fluid through a screening means and removing therefrom large particle size solids having a maximum dimension greater the internal diameter of the fluid transport means while passing through the screening means the solids-laden fluid containing small particle size solids having a maximum dimension smaller than the internal diameter of the fluid transport means and thereafter passing the solids-laden fluid containing the small particle size solids through the fluid transport means.

7 Claims, 4 Drawing Figures

METHOD AND APPARATUS FOR CLASSIFYING SOLIDS AND TRANSPORTING SOLIDS-LADEN FLUID

BACKGROUND OF THE INVENTION

The present invention relates to a method and apparatus for classifying solids and transporting solids-laden fluid containing large particle size solids which tend to plug a tubular fluid transport means and small particle size solids which will not plug the fluid transport means to thereby prevent such plugging. In a more particular aspect, the present invention relates to an improved heat exchange means adapted to transport a solids-laden fluid in indirect heat exchange with a heat exchange medium.

In many industrial operations, it is necessary to transport solids-laden fluid through tubular transport means. For example, in the fluid catalytic cracking of gas oils and/or topped crudes in a refinery, a slurry oil stream containing large size particles of contaminants, such as coke and tar, as well as residual amounts of small size particles of catalyst is separated from the reactor effluent. Normally, at least a portion of the slurry oil is cooled and recycled back to a separating zone in order to improve separation of desired products. Such cooling is normally carried out in a tube and shell type heat exchanger in which the slurry oil passes through the tubes of the heat exchanger while water is utilized as a cooling medium in the shell of the heat exchanger. Such cooling of the slurry oil serves the dual purpose of cooling the slurry oil as well as producing process steam from the cooling water. However, there is a tendency for large particles of contaminants, such as coke and tar, to plug the tubes of the heat exchanger thus eventually rendering the heat exchanger inefficient and eventually ineffective. At the present time, heat exchangers which have become plugged must be torn down and the tubes thereof reamed to remove the plugging solids and return the heat exchanger to its original efficiency. Obviously, this cleaning of the heat exchanger is costly and time consuming.

It would therefore be highly desirable to provide a method and apparatus whereby a solids-laden fluid containing large particle size solids which have a tendency to plug a tubular fluid transport means and small particle size solids which will not plug the transport means whereby the solids of large particle size are prevented from entering the tubular transport means while permitting the fluid containing the small particles to pass through the transport means. It would also be highly desirable to provide such a method and apparatus wherein a self-cleaning effect is produced.

SUMMARY OF THE INVENTION

The present invention relates to a method and apparatus for classifying solids and transporting a solids-laden fluid containing large particle size solids which tend to plug a tubular fluid transport means and small particle size solids which will not plug the transport means wherein the solids-laden fluid is passed through a screening means to remove large particle size solids having a maximum dimension greater than the internal diameter of the fluid transport means while passing through the screening means the solids-laden fluid containing small particle size solids having a maximum dimension smaller than the internal diameter of the fluid transport means and thereafter passing the solids-laden fluid containing the small particle size solids through the fluid transport means.

Thus, in accordance with the present invention, solids contained in a solids-laden fluid are classified as to size so as to remove large particle size solids which will tend to plug a tubular fluid transport means and small particle size solids which will not plug the transport means by passing the solids-laden fluid through a screening means having openings whose diagonal dimension is substantially the same as the internal diameter of the fluid transport means and thereafter passing the fluid containing the remaining small particle size solids which will not plug the fluid transport means through the fluid transport means.

In a preferred embodiment the present invention relates to a tube and shell type heat exchange apparatus in which the solids-laden fluid is first passed through a screen means and thence through the tube or tubes of the heat exchanger and the diagonal dimension of the openings of the screen means are substantially equal to the internal diameter of the tubes of the heat exchanger whereby large particle size solids which will tend to plug the tubes of the heat exchanger are removed by the screening means and the fluid containing small particle size solids which will not plug the tubes of the heat means are passed through the screen and through the tubes of the heat exchanger.

The present invention is particularly useful for cooling a slurry oil stream from a fluid catalytic cracking operation wherein a slurry oil containing large particles of contaminants, such a coke and tar, and small particle size solid catalyst as well as small particles of coke and tar is passed through a screening means and thence through the tubes of a tube and shell type cooler, the screen openings of the screening means having a diagonal dimension substantially equal to the internal diameter of the tubes in the heat exchanger. In this particular use, the apparatus has the additional advantage. of producing process steam from the cooling water passing through the shell of the heat exchanger.

It has also been found in practice that the apparatus of the present invention exhibits a self-cleaning action in that, while large particles of contaminants or the like which are screened out by the screening means will collect outside the screen, there is a tendency for the flowing solids-laden fluid to erode these larger particles until they are of small enough size to pass the screen and pass through the tubular fluid transport means without plugging the latter. Thus, a self-cleaning action takes place.

The present invention will be better understood by reference to the following detailed description of preferred embodiments when read together with the accompanying drawings.

DESCRIPTION OF THE PREFERRED EMBODIMENTS

Figure 1:
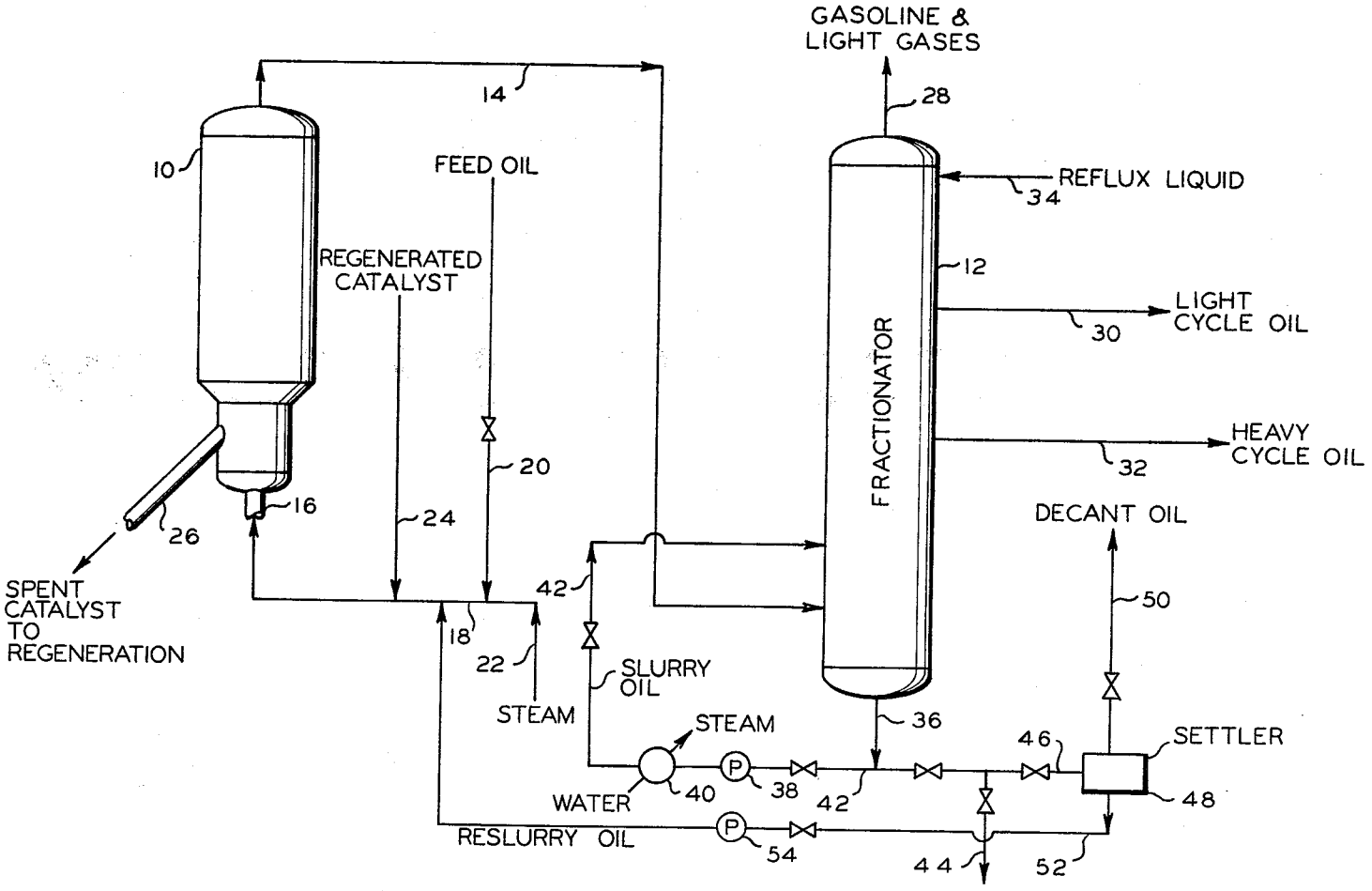
FIG. 1 is a simplified flow diagram of a fluid catalytic cracking system in which the invention of the present application may be utilized.

FIG. 1 of the drawings is a simplified flow diagram of one embodiment of a catalytic reactor system incorporating one embodiment of the novel apparatus of the present invention. FIG. 1 illustrates a fluidized type catalytic reator 10 connected to a fractionator 12 by a hot vapor transfer line 14. Various valves, pressure gauges and controls often present in such reactor systems have been omitted as not essential to the invention but can be utilized in manners and for purposes well known to those skilled in the art. This general system is old in the art as shown in Cross U.S. Pat. No. 3,133,014 and in Moyer et al U.S. Pat. No. 3,338,821.

A feed riser line 16, having a manifold section 18, is operatively connected to the reactor 10 in a manner which will allow a feedstock such as a gas oil and/or topped crude, introduced through line 20, and steam, introduced by means of line 22, to pass into reactor 10. Hot regenerated catalyst from a catalyst regeneration zone (not shown) or the like can be passed to riser 16 by means of a downcomer line 24, such that the feedstock and steam will carry the catalyst into the reactor. Spent catalyst which has been steam-stripped can be continuously withdrawn from the reactor and passed to said catalyst regeneration zone (not shown) by means of a downcomer line 26.

The catalyst is generally in the form of finely divided particles, or powder, which assumes a fluidized condition within the reactor 10, or is entrained as in a riser-reactor. Suitable cracking catalysts, which can be used in the practice of this embodiment, include acid activated bentonite clays, and synthetic composite gel catalyst systems such as silica-alumina, silica-magnesia, the molecular sieve type, and the like. The catalyst particles may range in size from about 100 to 400 mesh. A major portion of the particles may range between 20 and 80 microns in diameter. This size particle is easily fluidized in reactor 10 and easily conveyed through the catalyst regeneration equipment (not shown).

The reactor 10 can be any suitable type well known in the art. It is generally preferred to connect conduit 14 to reactor 10 by means of an interiorly disposed cyclone separator (not shown) which will remove almost all of the entrained catalyst from the hot hydrocarbon vapors before they enter line 14. However, some catalyst remains entrained in the hot vapors in line 14 and goes over into the lower part of fractionator 12 where it forms a slurry in the liquids therein. Quench (not shown) can be effected on stream 14 prior to its entering fractionator 12.

Fractionator 12 may be provided with the usual plurality of conventional fractionation trays (not shown), which may be bubble-cap, sieve, plate or other known types. These will serve to separate the converted hydrocarbons into different molecular weight fractions as they condense and/or evaporate in the fractionator. Gasoline and light gases pass overhead out of line 28. Light cycle oil is removed through line 30 and heavy cycle oil through line 32. If desired, separation can be increased by adding a refluxing liquid through line 34 near the top of fractionator 12.

The heaviest oil, containing some catalyst and therefore called "slurry oil", passes out the bottom of fractionator 12 through line 36. The slurry oil then passes through pump 38 and thence through cooler 40, in indirect heat exchange with cooling water. Heat exchanger 40 will be described in greater detail hereinafter. Cooled slurry then passes through line 42 to fractionator 12 to flow down over baffles (not shown), which may be a series of right angle steel members which serve to knock catalyst out of vapors passing upward therethrough. The downwardly flowing cooled slurry oil from conduit 42, passing over the baffles, serves to insure the washing back of catalyst below the baffles even though slurry oil has catalyst in it.

This completes the description of the major parts of the embodiment of FIG. 1 except that the slurry oil will normally build up so that some will need to be removed from the system and either disposed of through line 44 or, more preferably, removed through line 46 to settler or decant unit 48 where the major portion of the oil, substantially free of catalyst, can be withdrawn as a decant oil through line 50 and the catalyst concentrated reslurry oil in line 52 can be pumped by pump 54 into the manifold 18 and back to reactor 10.

Figure 2:
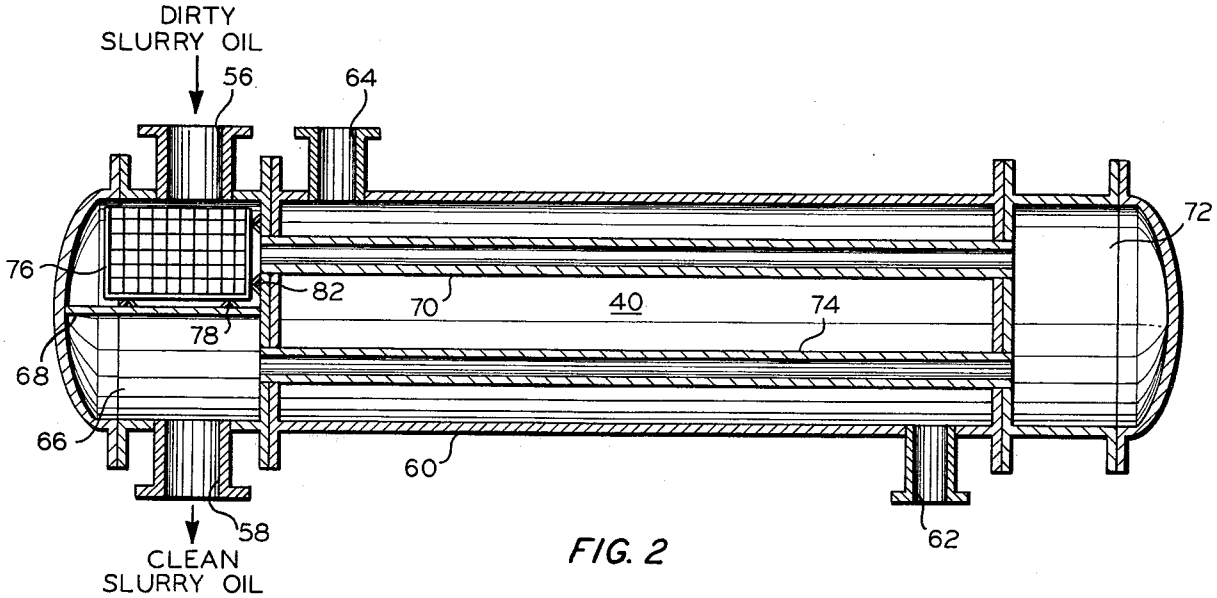
FIG. 2 is a more detailed cross-sectional view of a heat exchange means in accordance with the present invention which may be utilized in a system such as that of FIG. 1.

FIG. 2 of the drawings shows in somewhat greater detail the novel solids classifying and fluid transporting apparatus in accordance with the present invention, as a heat exchanger 40 which can be utilized in a system such as that of FIG. 1. As previously indicated, slurry oil such as that passing through line 42 and heat exchanger of FIG. 1 normally contains large particles of coke and tar as well as the small particulate catalyst solids and small particles of coke and tar. Consequently, such large particles have a tendency to plug the tubes of a tube and shell heat exchanger such as heat exchanger 40. In accordance with the present invention such plugging is prevented.

Specifically referring to FIG. 2, dirty slurry oil enters heat exchanger 40 through manifold 56 and is discharged as clean slurry oil through manifold 58. Cooling water is introduced to the shell 60 of heat exchanger 40 through manifold 62 and steam is discharged from the shell 60 of heat exchanger 40 through manifold 64. The dirty slurry oil enters a first half of a header section 66 of heat exchanger 40. Header section 66 is divided into two semicylindrical sections by divider 68. The slurry oil then passes through the interior of tube 70 of tube and shell heat exchanger 40, thence to end section 72 of heat exchanger 40 and finally through tube 74 back to the other half of header section 66. The tube and shell exchanger may take any desired form, for example the water inlet and steam outlet, 62 and 64, respectively, may be switched to opposite ends of the shell rather than the locations shown in FIG. 2. Also, tubes 70 and 74 may constitute a single tube connected by a return loop disposed in end portion 72 of heat exchanger 40, or may constitute a plurality of tubes.

Figure 4:
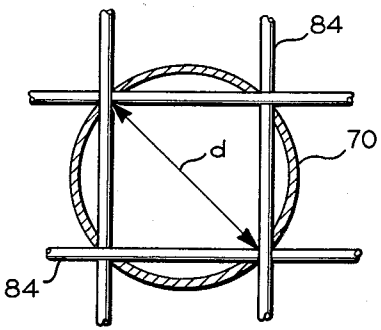
FIG. 4 illustrates the relative dimensions of the screen and tubes of the apparatus of FIG. 2.
Figure 3:
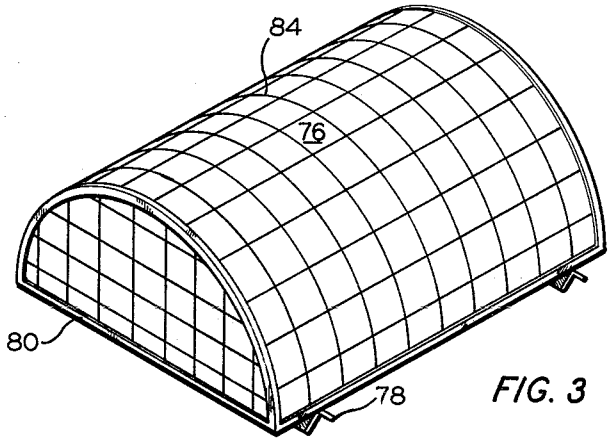
FIG. 3 is a perspective view of the screening means of the apparatus of FIG. 2.

In order to prevent plugging of tubes 70 and 74 by the previously-mentioned large particles of coke and tar and thus classify the solids in the slurry oil, heat exchanger 40 is provided with screen means 76, mounted in the half of header 66 which receives the dirty slurry oil. In this particular instance, the screen means 76 is a semi-cylindrical screen means as shown in FIG. 3. This screen means 76 is built on an appropriate frame 78, is spaced from divider 68 by means of spacers 80 and from the end of the shell by means of spacers 82 (FIG. 2). Formed on the screen means 76 and completely surrounding the same to form a closed screen structure is a screen mesh 84. The openings of screen mesh 84, as shown in FIG. 4, to illustrate relative dimensions only, have a diagonal dimension "d" which is substantially equal to the internal diameter of a fluid transport tube, such as tube 70 of heat exchanger 40. By utilizing a filter or screen the diagonal of whose openings are of substantially the same dimension as the internal diameter of the tubes of a tube and shell heat exchanger, large particles such as the coke and tar particles contained in the slurry oil are removed by the screen and thereby prevented from plugging the tubes of the heat exchanger. It has also been found, through use, that, while these larger particles build up around the screen means 70, as use continues there is a continual erosion of the particles by the flowing slurry oil thus providing a self-cleaning action. In the treatment of slurry oil, in the preferred embodiment, process steam is produced simultaneously with the cooling of the slurry oil.

Obviously, while specific embodiments of the invention have been described in connection with the cooling of slurry oil from a catalytic cracker, the novel apparatus of the present invention may be utilized in a wide variety of other environments where it is desired to remove larger particles, which tend to plug a transport tube, from a fluid stream while passing smaller particles, which will not plug the transport tube, and then transporting the fluid containing the smaller particles through the transport tubes.

While specific examples have been given and illustrated herein, it is to be understood that these are by way of example only and that many modifications of and substitutions therefor will be apparent to one skilled in the art.

What is claimed is:

1. Apparatus for classifying solids and transporting a solids-laden fluid comprising:

at least one elongated tubular fluid transport means of circular cross section having an inlet end and a discharge end and adapted to transport a solids-laden fluid therethrough; and at least one screening means mounted adjacent said inlet end of said transport means, having a plurality of square openings whose diagonal dimension is substantially equal to the internal diameter of said fluid transport means and adapted to screen out and prevent the passage into said fluid transport means of solids having a maximum dimension capable of plugging said fluid transport means and to pass therethrough said fluid containing solids having a maximum dimension incapable of plugging said fluid transport means.

2. Apparatus in accordance with claim 1 wherein the apparatus is a tube and shell type heat exchange apparatus adapted to pass solids-laden fluid through the tubes thereof.

3. Apparatus in accordance with claim 2 wherein the heat exchange means is a cooling means and said cooling means is adapted to pass water as a cooling medium through the shell portion thereof.

4. A method of classifying solids and transporting a solids-laden fluid containing large particle size solids which tend to plug a tubular fluid transport means of circular cross section and small particle size solids which will not plug said transport means, comprising:

passing said solids-laden fluid through a screen means having a plurality of square openings whose diagonal dimension is substantially equal to the internal diameter of said fluid transport means, thereby removing therefrom large particle size solids having a maximum dimension greater than the internal diameter of said fluid transport means and capable of plugging said fluid transport means while passing through said screening means said solids-laden fluid containing small particle size solids having a maximum dimension smaller than said internal diameter of said fluid transport means and incapable of plugging said fluid transport means; and passing said solids-laden fluid containing said small particle size solids through said fluid transport means.

5. A method in accordance with claim 4 wherein the temperature of the solids-laden fluid is adjusted by passing the solids-laden fluid through the tubes of a tube and shell type heat exchanger.

6. A method in accordance with claim 5 wherein the tube and shell type heat exchanger is a cooler, cooling water is passed through the shell portion of said cooler and steam is discharged from said shell portion of said cooler.

7. A method in accordance with claim 6 wherein the solids-laden fluid is a slurry oil stream separated from the reaction product of a fluidized type catalytic cracking reactor.

* * * * *